United States Patent [19]

Campener Torzo

[11] 3,958,776

[45] May 25, 1976

[54] COP MADE OF PLASTIC MATERIAL

[75] Inventor: Ferruccio Campener Torzo, Milan, Italy

[73] Assignee: Montefibre S.p.A., Milan, Italy

[22] Filed: July 8, 1974

[21] Appl. No.: 486,618

[30] Foreign Application Priority Data

July 10, 1973 Italy ..... 26391/73

[52] U.S. Cl. ..... 242/118.32; 242/118.7

[51] Int. Cl.[2] ..... B65H 75/10; B65H 75/12

[58] Field of Search ..... 242/118.32, 118.31, 242/118.3, 118.7, 46.21

[56] References Cited

UNITED STATES PATENTS

| | | | |
|---|---|---|---|
| 2,419,415 | 4/1947 | Morf | 242/118.31 |
| 3,403,872 | 10/1968 | Williams et al. | 242/118.31 |
| 3,454,235 | 7/1969 | Hurley | 242/118.32 |
| 3,556,423 | 1/1971 | Steffenini | 242/118.32 |

*Primary Examiner*—Leonard D. Christian

*Attorney, Agent, or Firm*—Stevens, Davis, Miller & Mosher

[57] ABSTRACT

A disposable cop is disclosed, made of plastic material, and consisting essentially of a cropped cylindrical body, hollow inside, and having from 12 to 20 longitudinal reinforcing ribs disposed around the inside circumference, and arranged substantially radially at a uniform distance from each other and widened for a short distance in the section above their middle part, said longitudinal reinforcing ribs being:

a. differentially and partially chamfered at the base of the cop, so as to provide inside the cylinder and with their free ends, a solid body or region having generating lines parallel to those of the cylinder, with an axial depth of about 12 mm and a cross-section which is a substantially equilateral triangle having radiused vertices, corresponding to the triangular entrainer of the spindle as required by ISO standards, and b. shorter by about 6 mm with respect to the total length of the cylinder at the head of the cop.

6 Claims, 7 Drawing Figures

COP MADE OF PLASTIC MATERIAL

The present invention relates to cops made of plastic materials. More particularly, the present invention relates to disposable cops made of plastic materials of relatively low cost.

By the term "cops", as used in this description and in the claims, is meant cropped cylindrical tubes or pipes which are adapted to be friction-fitted on the spindles of spinning frames, and on which the yarn is wound up to form cops or reels.

As is well known, the cops generally used in the textile industry have very sturdy and rigid walls in order to avoid any deformations caused by the tension exerted by the yarn. For this purpose the cops heretofore known have, in general, been made of wood, pressed paper, masonite, or of metal covered by a sheath of plastic material. Such cops, however, have the drawback of being heavy, bulky and in most cases rather expensive, wherefore it is necessary to recover and repair them for re-use.

An object of this invention is that of providing cops that are free of the above mentioned drawbacks. More particularly, an object of this invention is that of providing cops that are light and not cumbersome, rigid, and of very low cost so as not to require their recovery for reasons of economy.

It has now been found according to the present invention that these and other objects are attained by using cops made of a plastic material and having a cropped cylindrical body of circular cross-section, a hollow interior and from 12 to 20 longitudinal reinforcing ribs arranged substantially radially and uniformly spaced along the inside circumference of the cylindrical body. These ribs, which although rigid or relatively rigid have a sufficient flexibility as to enable them to be slightly deflected when the cop is slipped onto the spindle, widen for a short distance in the part above their middle line so as to enable them to exert a stronger grip on the spindle.

These longitudinal reinforcing ribs are made of the same plastic material that form the walls of the cop, they are co-molded with said walls, and they have an isosceles triangular cross-section with relatively wide base angles.

Moreover, and in correspondence with that part of the cop which acts as base when in place on the spindle, the longitudinal ribs are differentially and not completely chamfered so as to obtain, inside the cylinder and with the free ends of said ribs, a solid body having generating lines parallel to those of the cylinder itself, with an axial depth of 12 mm and a cross-section which is a substantially equilateral triangle having radiused vertices corresponding to the triangular entrainer (dragger) of the spindle required by ISO standards.

The longitudinal ribs, moreover, in the other end of the body corresponding to the head of the cop, are shorter by 6 mm with respect to the total length of the cylinder, thus forming a depression in which the count meter is disposed.

These and other characteristics of the disposable plastic cop which is the object of this invention will be still more clearly understood from the description that follows and with reference to the accompanying drawing wherein.

More specifically, the cop 1 has a hollow, cylindrical body provided with a series of longitudinal reinforcing ribs 2 arranged around the inside circumference in a substantially radial position, uniformly spaced from each other, and each having a profile which is substantially an isosceles triangle with relatively large base angles.

Each cop may have from 12 to 20 internal reinforcing ribs, although in practice best results are obtained with 16 ribs.

Figure 1:
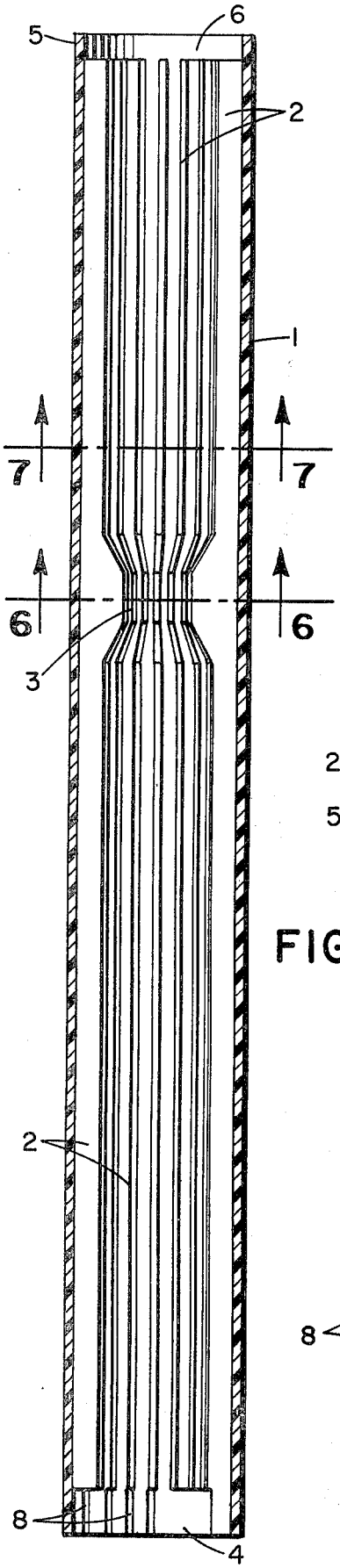
FIG. 1 shows schematically a longitudinal cross-section of the cop which is the object of this invention.
Figure 4:
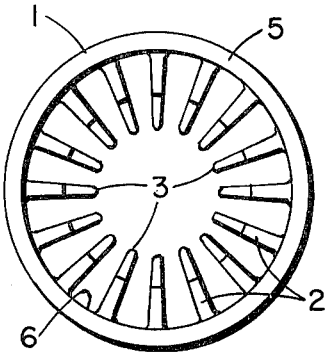
FIG. 4 shows schematically a plan view from above of the cop of the preceeding figures.
Figure 6:
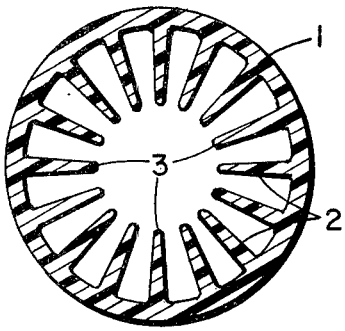
FIG. 6 shows a transverse cross-section of the cop of the preceding figures, on a plane passing through line 6—6 of FIG. 1.
Figure 5:
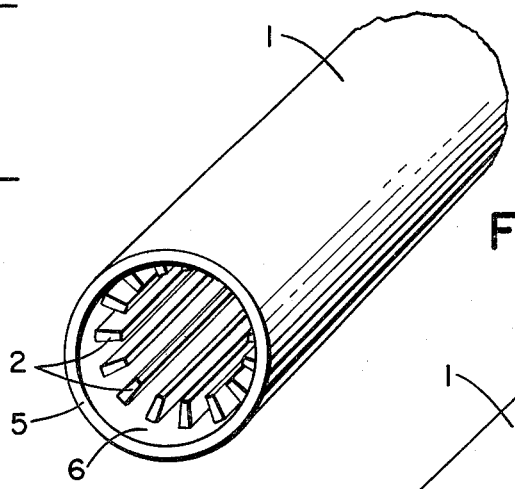
FIG. 5 shows a schematical perspective view of the top of the cop of the preceding figures.
Figure 3:
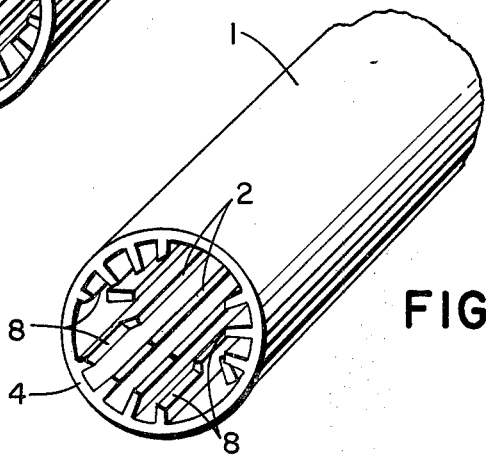
FIG. 3 shows the base of the cop of the preceding figures in a schematical perspective view.

The ribs 2 in the part above the middle section expand or widen, thereby narrowing the hole defined by their ends 3 in that part, and thereby allowing them (see FIG. 6) to exert a better hold on the spindle on which the cop is slipped in frictional engagement.

Figure 2:
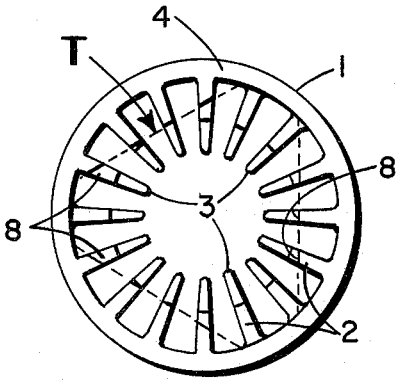
FIG. 2 shows schematically a bottom plan view of the cop.
Figure 7:
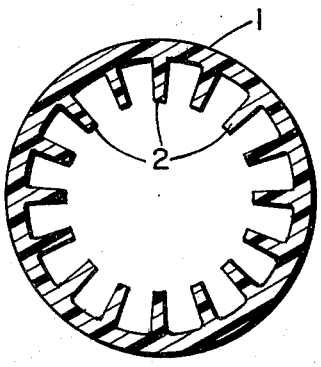
FIG. 7 shows a transverse cross-section of the cop of the preceding figures, on a plane passing through the line 7—7 of FIG. 1.

Corresponding with the base 4 of the cop 1, the ribs 2 are differentially and not completely chamfered (i.e., partially notched or cut off) so as to form inside the cylinder and with their free ends, the seating for the triangular portion carried by the rotating part of the spindle of the textile machine (drawing frame, twisting frame, etc.) which engages the cop. More particularly, the notches 8 are such as to form a triangular portion or shoulder having generating lines parallel to those of the cylinder itself, with an axial depth of 12 mm and, in plan view as seen in FIG. 2, a substantially equilateral triangle with radiused or rounded vertices. The triangular shoulder or socket is further indicated by a dotted line in Fig. 2 connecting the notches in the individual ribs. This particular configuration of the base 4 allows the cop to be slipped on and fixed directly on the spindle without requiring any further bushings.

Corresponding with the head 5 of the cop 1, the ribs 2 are shorter by 6 mm with respect to the total length of the cylinder, thus forming a depression 6 wherein is lodged the count meter.

The outer surface of the cop may be smooth but preferably it is roughened so as to avoid slippage of the yarn. In practice, best results will be obtained by providing a glazed outer surface.

The cops of this invention are made of a plastic material such as high impact polystyrene, ABS resin, etc., by reason of which they are very light and relatively cheap. Because of their relatively low cost, the cops of this invention may be considered as products "to be wasted" or disposable since their cost is considerably less than that required for reclaiming and possibly repairing them.

What is claimed is:

1. A light, relatively rigid, disposable cop made entirely of plastic material, and consisting essentially of a hollow cylindrical body having from 12 to 20 longitudinal reinforcing ribs disposed around the inner wall of said body, said ribs being arranged substantially radially at a substantially uniform distance from each other and being widened for a short distance in the section above their middle part for gripping the spindle on which the cop is to be mounted, said longitudinal reinforcing ribs being:

a. partially notched or cut off at the base of the cop so as to provide inside the hollow cylinder, and defining by their free ends, a region having generating lines parallel to those of the hollow cylinder, with an axial depth of about 12 mm and a cross-section which is in the form of a substantially equilateral triangle having rounded vertices, said cross-section corresponding to that of the triangular portion or shoulder of the spindle adapted to be engaged by the cop as required by ISO standards; and b. shorter at the top of the cop by about 6 mm with respect to the total length of the cylinder.

2. A cop according to claim 1, wherein the longitudinal reinforcing ribs are 16 in number.

3. A cop according to claim 1, wherein each of the reinforcing ribs has an isosceles triangular cross-section with relatively large base angles.

4. A cop according to claim 1, wherein the longitudinal reinforcing ribs, although relatively rigid, still have sufficient flexibility to be slightly deflected when the cop is slipped onto the spindle.

5. A cop according to claim 1, wherein the cop is made of high impact polystyrene.

6. A cop according to claim 1, wherein the cop is made of ABS resin.

* * * * *

UNITED STATES PATENT AND TRADEMARK OFFICE

CERTIFICATE OF CORRECTION

PATENT NO. : 3,958,776

DATED : May 25, 1976

INVENTOR(S) : Ferruccio Campaner TORZO

It is certified that error appears in the above-identified patent and that said Letters Patent are hereby corrected as shown below:

The inventor's name should be corrected to read

--Ferruccio Campaner Torzo--

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*